US007555791B1

(12) United States Patent
Pereira

(10) Patent No.: US 7,555,791 B1
(45) Date of Patent: Jul. 7, 2009

(54) BABY BOUNCER

(76) Inventor: Fred Pereira, P.O. Box 3048, Kailua-Kona, HI (US) 96745

( * ) Notice: Subject to any disclaimer, the term of this patent is extended or adjusted under 35 U.S.C. 154(b) by 0 days.

(21) Appl. No.: 11/900,281

(22) Filed: Sep. 12, 2007

(51) Int. Cl.
*A47D 9/02* (2006.01)

(52) U.S. Cl. ..... 5/101; 5/105; 5/109

(58) Field of Classification Search ..... 5/101, 5/104, 105, 108, 109; 297/DIG. 11
See application file for complete search history.

(56) References Cited

U.S. PATENT DOCUMENTS 3,186,008 A 6/1965 Fuller
3,653,080 A 4/1972 Hafele
3,806,966 A 4/1974 Thompson
3,851,343 A 12/1974 Kinslow, Jr.
4,081,869 A * 4/1978 Ash ..... 5/105
4,141,095 A 2/1979 Adachi
4,985,949 A 1/1991 Jantz
5,342,113 A 8/1994 Wu
5,464,381 A 11/1995 Wilson
5,615,428 A 4/1997 Li
5,660,597 A 8/1997 Fox et al.
6,574,806 B1 6/2003 Maher
6,774,589 B2 8/2004 Sato et al.

* cited by examiner

*Primary Examiner*—Michael Trettel
(74) *Attorney, Agent, or Firm*—Patent & Trademark Services; Joseph H. McGlynn

(57) ABSTRACT

A device for rocking or bouncing a baby chair. The device has a seat into which a baby can be placed. The seat is attached to a stand that provides a springy action to the baby seat. The stand has an adjustment mechanism so the stand can be adjusted to compensate for babies of different weights.

18 Claims, 2 Drawing Sheets

FIG.4
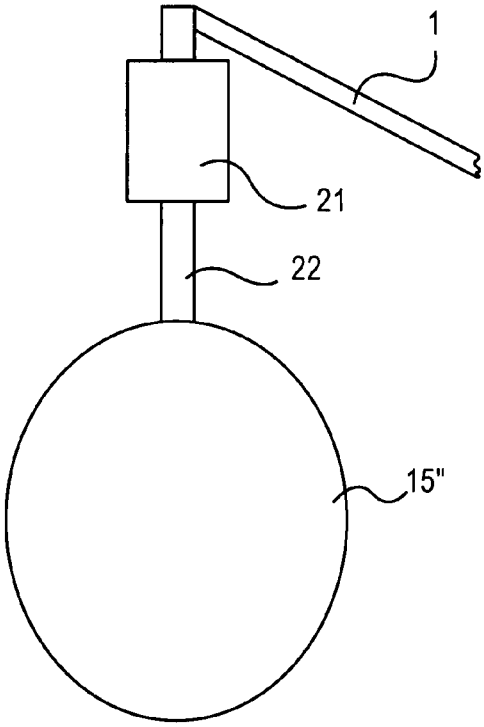
FIG.5
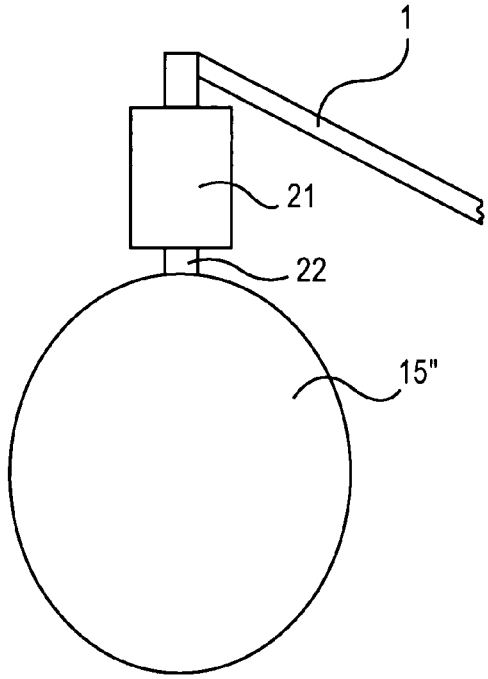
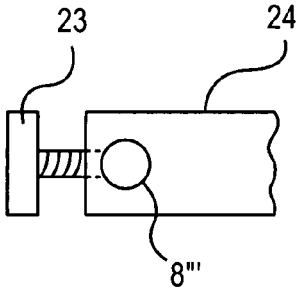
FIG.7
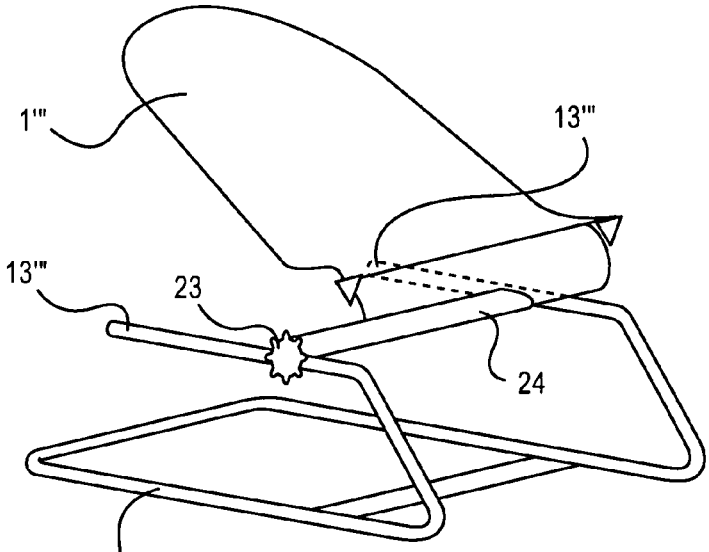
FIG.6

BABY BOUNCER

BACKGROUND OF THE INVENTION

This invention relates, in general, to baby chairs, and, in particular, to a device for bouncing baby chairs.

DESCRIPTION OF THE PRIOR ART

In the prior art various types of devices for bouncing baby chairs have been proposed. For example, U.S. Pat. No. 6,574,806 to Maher discloses a device for rocking a chair comprising a crank arm and a strap member that extends from the crank arm to the top of the chair. As the crank rotates the strap pulls on the chair to rock it.

U.S. Pat. No. 3,186,008 to Fuller discloses a device for rocking a chair comprising a cam that rotates within a slot in a chair base. The base is positioned on an incline so the base will move up and down as the cam rotates.

U.S. Pat. No. 5,342,113 to Wu discloses a device for rocking a chair comprising a rotary arm driven by a motor and a shaft is connected to the arm at one end and to the chair at the other end so as the arm rotates the shaft pulls on the chair to rock it.

U.S. Pat. No. 3,653,080 to Hafele discloses a device for rocking a chair comprising a rotary arm driven by a motor and a shaft is connected to the arm at one end and to the chair at the other end so as the arm rotates the shaft pulls on the chair to rock it.

U.S. Pat. No. 6,774,589 to Sato et al discloses a device for rocking a chair comprising a solenoid for bi-directionally attracting a magnetic member on the chair.

U.S. Pat. No. 4,985,949 to Jantz discloses a device for rocking a chair comprising a drive means consisting of an eccentric mounted to the output of a drive unit and slidably connected to a lifting member which converts rotational energy of the drive unit to vertically reciprocating motion of the lifting member.

U.S. Pat. No. 3,851,343 to Kinslow, Jr. discloses for rocking a chair comprising a rotary arm driven by a motor and a shaft is connected to the arm at one end and to the chair at the other end so as the arm rotates the shaft pulls on the chair to rock it.

U.S. Pat. No. 5,615,428 to Li discloses a device for rocking a chair comprising an elastic cord attached at one end to the chair and attached to a pivoting arm at the other end, and the arm is rotated by a motor.

U.S. Pat. No. 5,464,381 to Wilson discloses a device for rocking a chair comprising a motor with an eccentric which provides motion for the seat.

U.S. Pat. No. 5,660,597 to Fox et al discloses a device for rocking a chair comprising a unit that attaches to the chair and provides a vibrating motion.

U.S. Pat. No. 4,141,095 to Adachi discloses a device for rocking a chair comprising a chair pivoted at one end to a U-shaped stand and a rocking mechanism for moving the chair about the pivot.

U.S. Pat. No. 3,806,966 to Thompson discloses a device for rocking a cot comprising a wheel which is driven by a motor and the wheel has a pin which engages a slot on the cot, so the revolving pin moves the cot up and down as it rotates.

SUMMARY OF THE INVENTION

The present invention is directed to a device for bouncing a baby chair. The device has a seat into which a baby can be placed. The seat is attached to a stand that provides a springy action to the baby seat. The stand has an adjustment mechanism so the stand can be adjusted to compensate for babies of different weights.

It is an object of the present invention to provide a new and improved baby chair.

It is an object of the present invention to provide a new and improved baby chair that can compensate for different size babies.

It is an object of the present invention to provide a new and improved baby chair that is easily adjustable for different size babie These and other objects and advantages of the present invention will be fully apparent from the following description, when taken in connection with the annexed drawings.

BRIEF DESCRIPTION OF THE DRAWINGS

FIG. 4 is a side view of another drive of the present invention.

FIG. 5 is a side view of the drive mechanism of FIG. 4 in another position.

FIG. 6 shows a perspective view of the present invention with a different locking mechanism.

FIG. 7 shows a partial view of the locking mechanism of FIG. 6.

DESCRIPTION OF THE PREFERRED EMBODIMENT

Figure 1:
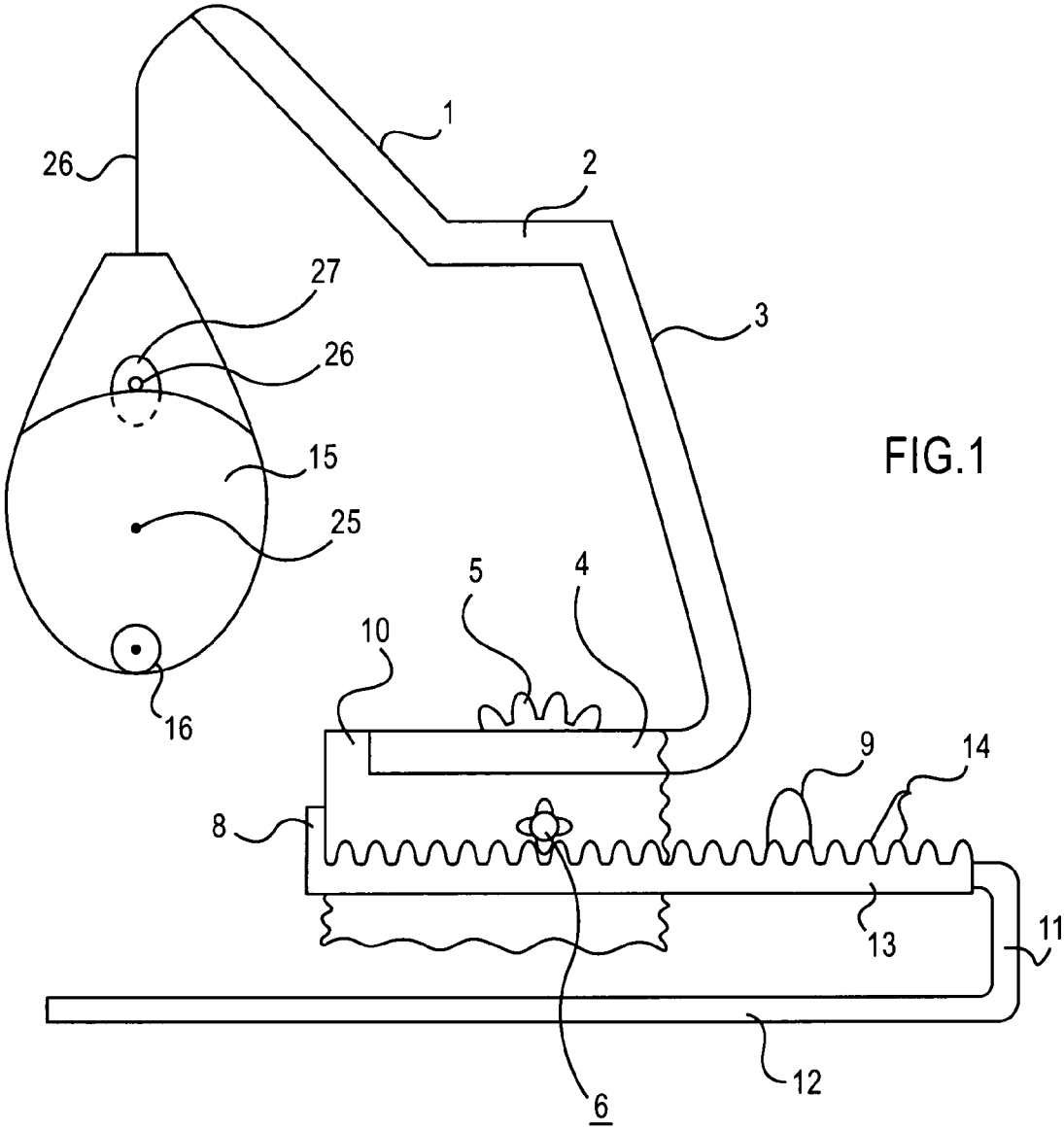
FIG. 1 is a side view of the present invention.

Referring now to the drawings in greater detail, FIG. 1 shows a baby seat or chair having a back rest 1 which is attached to a seat portion 2 which in turn is attached to a support portion 3. It should be noted that the seat shown in FIG. 1 is merely illustrative of a baby seat, and other shapes could be used without departing from the scope of the present invention.

The support portion 3 has a horizontal portion 4 which is secured, in any conventional manner, to a support block 10, most of which has been removed from FIG. 1 for clarity. The support block 10 receives and supports the horizontal portion 4 in any conventional manner. The chair has a second horizontal portion 13 which fits into the support block 10, but is free to move with respect to the block. The top of the second horizontal portion 13 has a series of valleys 9 which form teeth 14 in between the valleys. In addition, the end of the second horizontal portion 13 has a stop 8 so the gear 6 can not move off the second horizontal portion 13. The chair has a second support portion 11 and a third horizontal portion 12 which form the rest of the support for the chair. A control knob 5 is mounted for rotation to the block 10 in any conventional manner. The knob 5 is connected to gear 6 so that when knob 5 is rotated, gear 6 will also rotate. Gear 6 engages the teeth 14 on the top of the second horizontal portion 13 so when knob 5 is turned in one direction the first horizontal portion 4 moves toward the right in FIG. 1. When knob 5 is turned in the opposite direction the first horizontal portion 4 moves toward the left in FIG. 1.

The portions 11, 12, 13 of the support stand are made from a springy material so the upper leg 13 will move up and down with respect to the lower leg 12. The adjustment mechanisms 5, 6, 9 and 14 are designed to compensate for different size babies. As shown in FIG. 1, the seat is adjusted to hold about a twenty pound baby. If the baby weighs more than twenty pounds, the adjustment mechanisms would be used to move the blocks 10 to the right in FIG. 1. Since the top leg 13 is essentially a cantilevered beam, this would reduce the moment arm of the beam making it more difficult for the leg 13 to move up and down. If the baby weighs less than twenty pounds, the adjustment mechanisms would be used to move the blocks 10 to the left in FIG. 1. Since the top leg 13 is essentially a cantilevered beam, this would increase the moment arm of the beam making it less difficult for the leg 13 to move up and down. Therefore, the adjustment mechanisms allow the present invention to be adjusted for virtually any size baby.

In order to move the upper leg 13 (and the seat secured to leg 13) up and down, a motor driven mechanism is attached to the back portion 1 of the seat by any conventional attachment means 26. A motor 27 is provided with a first wheel 26 that will be driven by the motor. The wheel 26 engages a second wheel 15 which rotates about a pivot point 25, so the wheel 27, driven by the motor 13, will cause wheel 15 to rotate. Wheel 15 has a weight 16 attached thereto by any conventional means. The weight 16 will throw the wheel 15 out of balance as it rotates, which will cause a vibration in attachment means 26, through seat 1, 2, 3, through block 10, and eventually into arm 13. Since the arm 13 is springy, the seat 1, 2, 3 will move up and down and, in so doing, will entertain a baby seated in the seat.

It should be noted that a framework will support motor 27, and wheels 26, 15, however it has been removed from FIG. 1 for clarity. Also, any motor can be used in the present invention including, but not limited to, an AC motor, a DC motor, a battery operated motor, or a motor operated by a mechanical means such as a spring.

Figure 2:
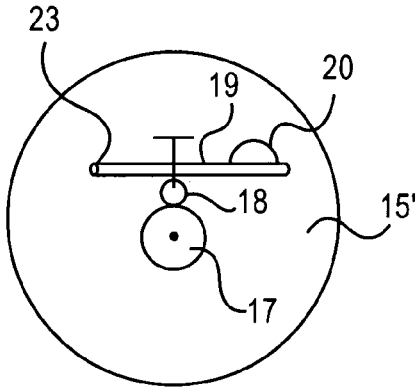
FIG. 2 is a side view of a drive mechanism in one position of the present invention.
Figure 3:
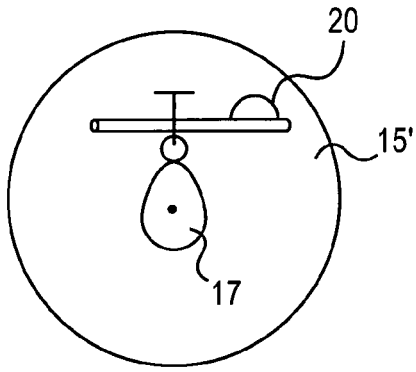
FIG. 3 is a side view of the drive mechanism of FIG. 2 in another position.

FIGS. 2 and 3 show a different operating means for the seat of FIG. 1. Wheel 15' (which is essentially wheel 15 in FIG. 1 without weight 16) has a cam 17 secured thereto which moves a follower 18 as the wheel 15' rotates. The wheel 15' is rotated by a motor (not shown in FIGS. 2, 3) like the motor 15 in FIG. 1. The follower 18 is connected to a beam 19, by any conventional means, which is pivoted at 23 on one end, and which has a weight 20 at the other end. As the cam 17 rotates from a down position, as shown in FIG. 2) to an up position (shown in FIG. 3) it moves the follower 18 which in turn pivots the beam 19 up. As the follower moves to the down position, the weight causes the beam 19 to move from the position shown in FIG. 3 to the position shown in FIG. 2, thereby causing the wheel 15' to vibrate which will vibrate the seat 1, 2, 3.

FIGS. 4 and 5 show a different activation mechanism. Wheel 15" (which is essentially wheel 15 in FIG. 1 without weight 16) has a solenoid 21 secured thereto by any conventional means. The solenoid 21 can be operated by the same motor 13 or it can be operated by a separate motor. The solenoid 21 moves a shaft 22 up (FIG. 5) and down (FIG. 4) as the solenoid 21 is turned on and off. The shaft 22 is secured to the wheel 15" in a way so the wheel will move up and down with the shaft 22. In this way the wheel will vibrate which will cause the seat 1, 2, 3 to vibrate as in FIGS. 1, 2, 3. Once the wheel, which is essentially just a weight, is started up and down by the solenoid it will continue in an up and down motion for a while even after the solenoid is turned off.

FIGS. 6 and 7 show a different securing means for adjustably attaching the seat 1'" to the springy legs 13'" which are supported on legs 12'" in the same manner as legs 13 and 12 in FIG. 1. A bar 24 is secured, in any conventional manner, to the seat. The bar 24 has apertures that receive the legs 13'". A set screw 23 is threaded into the bars 24. In order to adjust the seat for different size babies, the set screw 23 will be loosened, the bar 24 will be moved to a new location, and then the set screw will be tightened to secure the bar in the new location. In all other respects, the device will operate in the same manner as the FIG. 1 device. It should be noted that the motor and wheels have been removed from FIGS. 6 and 7 for clarity.

Although the Baby Bouncer and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A bouncing baby chair comprising:
- a seat having a back rest attached to a seat portion, and
- said seat portion is attached to a support portion,
- said support portion having adjustment means for moving and retaining said seat in a forward and backward direction, and
- said seat having means for moving said seat in an up and down direction, and
- wherein said adjustment means for moving said seat in a forward and backward direction comprises:
- a block having a length and a width,
- said block having means for securing it to a leg,
- said leg extending along said length of said block, and
- means for adjustably securing said block to said leg, and
- wherein said block has rotatable means for adjustably moving said block with respect to said leg.

2. The bouncing baby chair as claimed in claim 1, wherein said means for adjustably moving said block with respect to said leg moves said block along a length of said leg.

3. The bouncing baby chair as claimed in claim 1, wherein said block has a knob rotatably mounted thereto, and
- a gear mounted to said knob so said gear rotates when said knob rotates.

4. The bouncing baby chair as claimed in claim 3, wherein said leg has a plurality of teeth extending along a length of said leg.

5. The bouncing baby chair as claimed in claim 4, wherein said leg has a stop at one end for preventing said gear from moving off said leg.

6. The bouncing baby chair as claimed in claim 1, wherein said means for moving said seat in an up and down direction comprises;
- a first wheel,
- means for rotating said first wheel, and
- said first wheel engages a second wheel, and
- said second wheel has a weight attached thereto.

7. The bouncing baby chair as claimed in claim 1, wherein said means for moving said seat in an up and down direction comprises:
- a cam,
- means for rotating said cam, and
- a follower which moves in response to movement of said cam, and
- a beam pivot at one end,
- a weight secured to an opposite end of said beam, and
- said follower secured to said beam so said beam moves up and down as said cam rotates.

8. The bouncing baby chair as claimed in claim 1, wherein said means for moving said seat in an up and down direction comprises:
- a solenoid, a shaft secured to said solenoid, and said solenoid moves said shaft from a first position to a second position, and a wheel secured to said shaft so that said wheel moves up and down as said shaft moves up and down.

9. The bouncing baby chair as claimed in claim 1, wherein said support portion having adjustment means for moving and retaining said seat in a forward and backward direction extends across said seat portion and has an aperture in opposite ends, and a leg extending through each of said apertures, and set screws extend through opposite ends of said adjustment means for moving and retaining said seat in a forward and backward direction, and said set screws engage said legs in order to hold said baby chair in a selected position.

10. The bouncing baby chair as claimed in claim 1, wherein said means for moving said seat in an up and down direction comprises:

a solenoid, a shaft secured to said solenoid, and said solenoid moves said shaft from a first position to a second position, and a weight secured to said shaft so that said weight moves up and down as said shaft moves up and down.

11. A bouncing baby chair comprising:

a seat having a back rest attached to a seat portion, and said seat portion is attached to a support portion, and a block having a length and a width, said block having means for securing it to a leg, said leg extending along said length of said block, and means for adjustably securing said block to said leg, and wherein said block has a gear secured thereto, said gear engages teeth on said leg for adjustably moving said block with respect to said leg.

12. The bouncing baby chair as claimed in claim 11, wherein said teeth move said block along a length of said leg.

13. The bouncing baby chair as claimed in claim 11, wherein said block has a knob for rotating said gear.

14. The bouncing baby chair as claimed in claim 13, wherein said leg has a plurality of valleys extending along a length of said leg, and areas between said valleys form said teeth.

15. The bouncing baby chair as claimed in claim 13, wherein said leg has a stop for preventing said gear from moving too far.

16. The bouncing baby chair as claimed in claim 11, wherein said baby chair additionally comprises:

a first wheel, means for rotating said first wheel, and said first wheel engages a second wheel, and said second wheel has a weight attached thereto.

17. The bouncing baby chair as claimed in claim 11, wherein said baby chair additionally comprises:

a cam, means for rotating said cam, and a follower which moves in response to movement of said cam, and a beam pivot at one end, a weight secured to an opposite end of said beam, and said follower secured to said beam so said beam moves up and down as said cam rotates.

18. The bouncing baby chair as claimed in claim 11, wherein said baby chair additionally comprises:

a solenoid, a shaft secured to said solenoid, and said solenoid moves said shaft from a first position to a second position, and a wheel secured to said shaft so said wheel moves up and down as said shaft moves up and down.

* * * * *